US005400729A

United States Patent [19]

Bryant

[11] Patent Number: 5,400,729

[45] Date of Patent: Mar. 28, 1995

[54] SEWING APPARATUS FOR MAKING COMPOSITE DRAW CORD/ELASTIC WAISTBAND

[76] Inventor: Don E. Bryant, 1508 Heritage Dr., Columbia, Tenn. 38401

[21] Appl. No.: 87,916

[22] Filed: Jul. 6, 1993

[51] Int. Cl.[6] ..... D05B 27/00

[52] U.S. Cl. ..... 112/121.26; 112/305; 112/139; 112/262.1

[58] Field of Search ..... 112/121.26, 152, 139, 112/305, 312, 313, 314, 318, 322, 262.1

[56] References Cited

U.S. PATENT DOCUMENTS

| | | | |
|---|---|---|---|
| Re. 33,586 | 5/1991 | Graff . | |
| 735,560 | 8/1903 | Müller . | |
| 2,088,302 | 7/1937 | McKeever . | |
| 2,551,044 | 5/1951 | Ottinger et al. . | |
| 2,706,456 | 4/1955 | Stangler | 112/152 |
| 3,038,427 | 6/1962 | Leslie | 112/139 X |
| 3,150,621 | 9/1964 | Warnock | 112/139 X |
| 3,236,070 | 2/1966 | Clayton, Jr. . | |
| 3,887,968 | 6/1975 | Lynam . | |
| 4,466,137 | 8/1984 | Carnaghi . | |
| 4,477,928 | 10/1984 | Graff . | |
| 4,998,965 | 3/1991 | Easom | 112/313 X |
| 5,168,581 | 12/1992 | Garcia et al. . | |
| 5,226,379 | 7/1993 | Everett | 112/139 X |

FOREIGN PATENT DOCUMENTS

| | | |
|---|---|---|
| 2295681 | of 1976 | France . |
| 17330 | of 1898 | Germany . |
| 1208680 | of 1966 | Germany . |
| 713891 | of 1966 | Italy . |
| 720854 | of 1966 | Italy . |
| 632522 | of 1949 | United Kingdom . |
| 1392199 | of 1975 | United Kingdom . |
| 1392200 | of 1975 | United Kingdom . |
| 1456922 | of 1976 | United Kingdom . |

*Primary Examiner*—Clifford D. Crowder
*Assistant Examiner*—Paul C. Lewis
*Attorney, Agent, or Firm*—Rhodes, Coats & Bennett

[57] ABSTRACT

A sewing apparatus combines an elastic band with a non-elastic draw cord to form a composite band. The apparatus includes a sewing machine for sewing the draw cord to one surface of the elastic band. The sewing machine forms a plurality of stitches that collectively define a longitudinally extending channel encasing the draw cord. The elastic band is fed through the sewing machine by a set of feed rollers disposed upstream from the sewing machine and a set of draw rollers disposed downstream of the sewing machine. The draw rollers are operated at a higher feed rate than the feed rollers to stretch a segment of the elastic band as it passes through the sewing machine. The draw cord is fed through the sewing machine in side-by-side relationship with the elastic band and is secured to the band while the band is in a stretched condition. The sewing apparatus of the present invention can be used in line with a knitting machine in which the elastic band is formed, or can be used standing alone in an independent operation.

41 Claims, 4 Drawing Sheets

SEWING APPARATUS FOR MAKING COMPOSITE DRAW CORD/ELASTIC WAISTBAND

FIELD OF THE INVENTION

The present invention relates generally to sewing apparatuses, and more particularly to a sewing apparatus for securing a non-elastic draw cord to an elastic band to form a composite band.

BACKGROUND OF THE INVENTION

Many types of clothing, such as athletic shorts and sweat pants, use an elastic waistband in combination with a draw cord so that the garment can be worn by persons of different size. In most garments of this type, the elastic waistband and draw cord are incorporated into the garment in separate steps. First, the waistband is stretched and sewn to the garment. The second step involves forming a channel for the draw cord and then inserting the draw cord into the channel. The draw cord is inserted into the channel by inserting a flexible wire with a hook into the channel and pulling the draw cord through the channel. This technique is labor intensive and significantly increases production cost.

Recently, it has been proposed to form the draw cord as an integral part of the waistband in order to eliminate one step in the construction of garments. For example, U.S. Pat. No. 4,477,928 discloses an elastic band in which the draw cord is interwoven with the thread of the elastic band. One disadvantage of this process is that it requires the knitting or weaving machine used to manufacture the bands to be specially set up before beginning production of the composite waistband. Setting up the knitting and weaving machines can be a time-consuming process during which the machine is out of production. Once the knitting or weaving machine is properly set up to produce the composite waistband, the manufacturer will ordinarily produce a relatively large inventory of composite waistbands before switching production back to conventional elastic bands.

U.S. Pat. No. 5,040,244, discloses a composite waistband and draw cord in which the draw cord is releasibly secured to the surface of the waistband by an adhesive. However, the manufacturer of this type of composite waistband requires the use of special manufacturing equipment to heat and cure the adhesive.

SUMMARY AND OBJECTS OF THE INVENTION

The present invention is an apparatus for manufacturing composite bands from an elastic band and a draw cord. The apparatus uses a conventional sewing machine for securing the draw cord to one surface of the elastic band. The elastic band and draw cord are fed through the sewing machine with relationship. The sewing machine secures the draw cord to the elastic band by forming a plurality of stitches which extend over the draw cord and interlace with the elastic band on either side of the draw cord.

The feeding system includes a set of feed rollers disposed upstream from the sewing machine and a set of draw rollers disposed downstream from the sewing machine. The draw rollers are operated at a higher feed rate than the feed rollers so that the elastic band is stretched as it passes through the sewing machine. Thus, the length of the draw cord attached to the elastic band will be longer than the length of the elastic band in a relaxed state.

A band guide guides the elastic band as it is fed through the sewing machine. The band guide includes a pair of laterally adjustable guide members which can be adjusted to position the elastic band or to accommodate bands of different sizes. A cord guide aligns the draw cord in predetermined relationship with the elastic band as it is fed into the sewing machine.

The present invention allows the draw cord to be secured to the elastic band at any time after the manufacture of the elastic band. For example, the draw cord can be secured as part of the continuous process immediately following the knitting or weaving process in which the elastic band is formed. Alternately, the elastic band can be manufactured and stored for an extended length of time before the draw cord is secured to the band. Thus, the apparatus of the present invention permits a greater degree of flexibility in planning inventory. Further, the apparatus of the present invention avoids the necessity of halting the knitting or weaving process to set up for production of composite bands since the draw cord can be attached to the elastic band in an entirely independent operation.

Other objects and advantages of the present invention will become apparent and obvious from a study of the following description and the accompanying drawings which are merely illustrative of such invention.

DETAILED DESCRIPTION OF THE INVENTION

Figure 1:
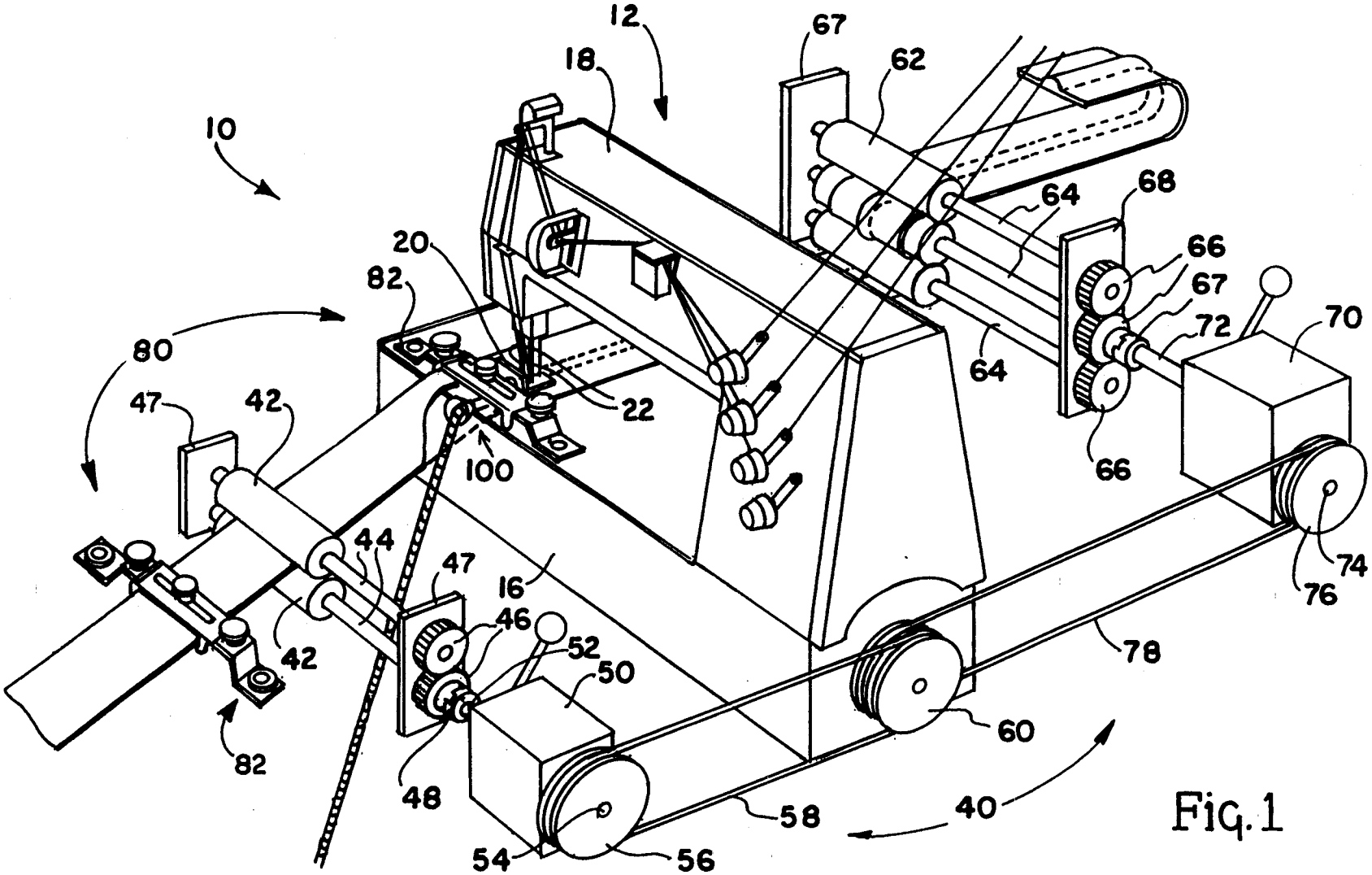
FIG. 1 is a perspective view of the sewing apparatus of the present invention.
Figure 4:
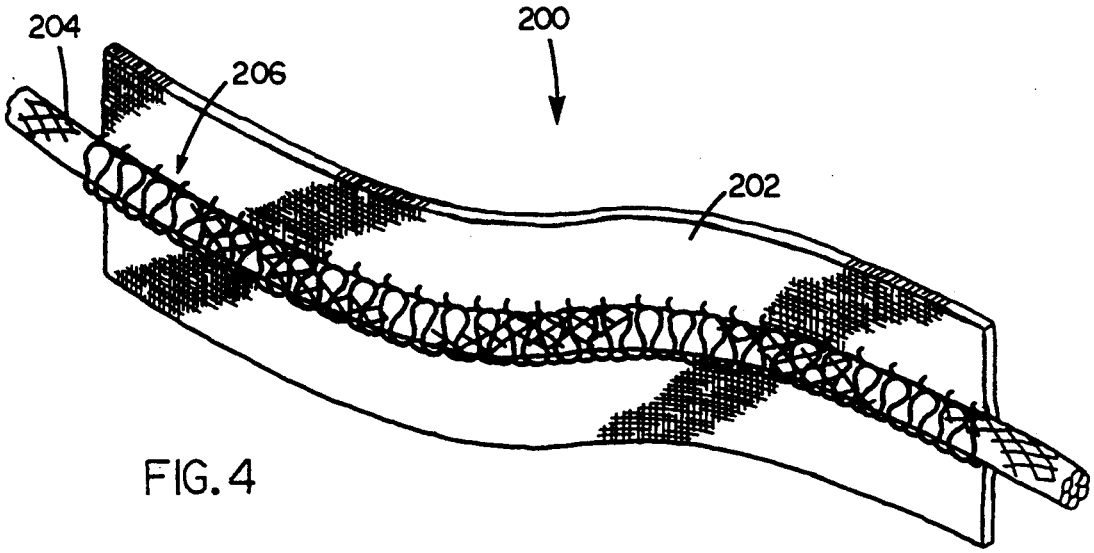
FIG. 4 is a perspective view illustrating the composite band produced by the present invention.

Referring now to the drawings, and particularly to FIG. 1, an apparatus is shown for combining an elastic band 202 with a draw cord 204 to form a composite band 200. The composite band 200 produced by the present invention is shown in FIG. 4. The composite band 200 comprises an elongated band or web made of an elastic material and a draw cord 204. The draw cord may be made of either a non-elastic or elastic material, depending on the end product. The draw cord 204 is disposed adjacent one surface of the elastic band 202 and extends in a longitudinal direction. The draw cord 204 is secured to the elastic band 202 by sewing threads. The sewing threads form a plurality of stitches extending over the draw cord 204 and collectively define a channel for the draw cord 204. The draw cord 204 is free to slide within the channel formed by the sewing thread.

The apparatus generally comprises a sewing machine 12 for sewing the draw cord 204 to one surface of the elastic band 202, means for feeding the elastic band 202 and draw cord 204 in side-by-side relationship through the sewing machine 12, band guide means for guiding the elastic band 202 as it is fed through the sewing machine 12, and a cord guide means for aligning the draw cord 204 with the elastic band 202 as it is fed through the sewing machine 12.

The sewing machine 12 is a conventional hidden stitch sewing machine such as JUKI, Model 8860. The sewing machine 12 includes a sewing head 14 having a base 16 and a sewing arm 18 extending over the base 16. A pressure foot 20 extends downwardly from the sewing arm 18 and applies pressure to the elastic band 202 as it is passed through the sewing machine 12. The pressure foot 20 is modified by forming a groove 20*a* in the underside of pressure foot 20 to accommodate the draw cord 204. No other modifications to the sewing machine 12 are required. A pair of sewing needles 22 are disposed in side-by-side relationship for stitching the sewing thread to the elastic band 202 as hereinafter described.

The sewing head 14 of the present invention requires three sewing threads—one for each sewing needle 22 and one for the interlooper, which is a component of the sewing machine 12. The sewing threads are drawn from bobbins 24 which are mounted on a frame 26. (See FIG. 2). The sewing threads pass through respective thread sensors 118, 120, and 122. The sensors 118, 120, and 122 are mounted to the frame 26 above respective bobbins 24. The function of the sensors 118, 120 and 122 is described below.

The sewing machine 12 is driven by a clutch motor 28. (See FIG. 2). The clutch motor 28 includes a clutch arm 32. The clutch arm 32 is connected by a link rod 34 to a treadle 36 to permit manual operation of the sewing head 14. A clutch cylinder 38 is connected to the clutch arm 32 to permit automatic operation as will be hereinafter described. Power is supplied to the clutch motor 28 through a power supply line 29. A main power switch 31 is disposed in the power supply line 34 for powering the clutch motor 28.

Since the construction and operation of sewing machines is well-known to those skilled in the art, further description is omitted for the sake of brevity.

Referring back to FIG. 1, the feed system 40 comprises a set of feed rollers 42 and a set of draw rollers 62. The feed rollers 42 are mounted on counter-rotating shafts 44 having intermeshing gears 47. The roller shafts 44 are rotatably journalled in supports 48. The draw rollers 62 are also mounted on parallel shafts 64 which are operatively connected by intermeshing gears 66. The roller shafts 64 are rotatably journalled in supports 67. The draw rollers 62 should preferably include a circumferential groove (not shown) to accommodate the draw cord 204 in the composite band 200. In the preferred embodiment, two feed rollers 42 and three draw rollers 62 are used, although a different number could be used.

Both the feed rollers 42 and draw rollers 62 are driven from the sewing head 14 by drive means. The drive means preferably includes gear boxes 50, 70 having output shafts 52, 72, drive pulleys 56, 76 and drive belts 58, 78. Each set of rollers 42 and 62 is connected by a respective coupling 48, 68 to the output shaft 52, 72 of a gear box 50, 70. The gear boxes 50 and 70 are variable so that the speed of the rollers 42 and 62 can be adjusted. Variable gear boxes, such as a zero max, are well-known in the art. A drive pulley 56, 76 is mounted on the input shaft 54, 74 of the gear box 50, 70. Drive belts 58, 78 operatively connect the drive pulleys 56, 76 with a main drive pulley 60 on the sewing head 14. Thus, the feed rollers 42 and draw rollers 62 will operate whenever the sewing head 14 is operated.

During operation, the elastic band 202 is fed through the sewing machine 10 by the feed rollers 42 and draw rollers 62. The draw rollers 62 also pull the draw cord 204 through the sewing machine 10. The draw cord 204 does not pass through the feed rollers 42. The draw rollers 62 are operated at a higher feed rate than the feed rollers 42 so that the elastic band 202 is stretched as it passes through the sewing machine. For example, if it is desired to apply 1½ feet of draw cord 204 to each one foot of band material, the draw rollers 62 would be operated at 1½ times the feed rate of the feed rollers 42. By varying the relative feed rate between the feed rollers 42 and draw rollers 62, varying degrees of stretching can be achieved.

A band guide 80 is provided for guiding the elastic band 202 as it is fed through the sewing machine 10. The band guide 80 comprises first and second guide assemblies 82 disposed on opposite sides of the feed rollers 42. One of the guide assemblies 82 is mounted on the base 16 of the sewing head 14 adjacent to the pressure foot 20. The other guide assembly 82 is disposed on the upstream side of the feed rollers 42.

Figure 3:
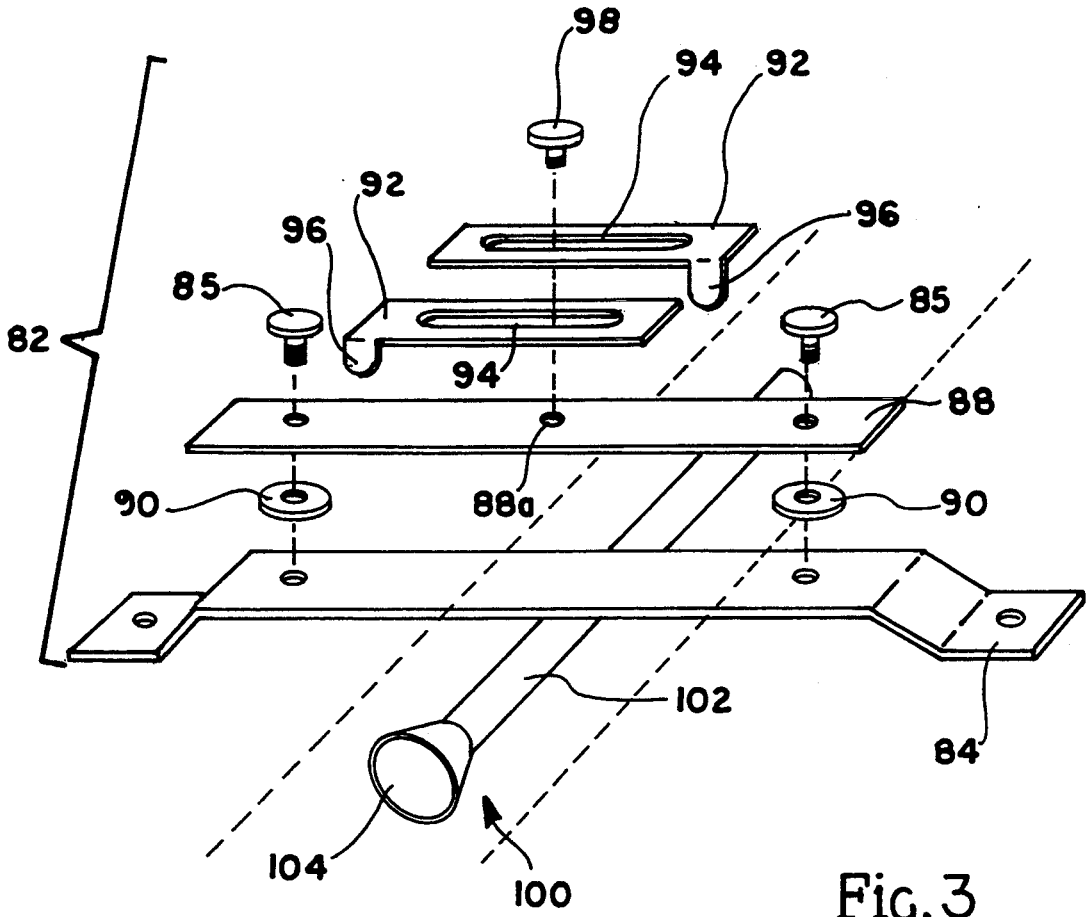
FIG. 3 is a perspective view illustrating one of the band guides.

Referring now to FIG. 3, the construction of the guide assembly is shown. The guide assembly 82 includes a base member 84, and a top plate 88. The base member 84 has a pair of threaded openings 86 which are engaged by screws 85 to secure the top plate 88 to the base member 84. Spacers 90 are disposed between the base member 84 and top plate 88 to form an opening therebetween through which the elastic band 202 passes.

A pair of guide members 92 are mounted above the top plate 88. Each guide member 92 has a longitudinally extending slot 94. An adjusting screw 98 extends through the slot 94 in each of the guide members 92 and is threadably engaged with a screw hole 88*a* in the top plate 88. Each of the guide members 92 includes a downwardly projecting guide tab 96. The guide tabs 96 extend downwardly on respective sides of the elastic band 202 to confine the elastic band 202 between the guide tabs 96. By loosening the adjusting screw 98, the guide members 92 can be adjusted inwardly and outwardly to accommodate elastic band 202*s* of different size. Also, the guide members 92 can be moved sideways while maintaining the spacing between the guide tabs 96 to change the lateral position of the elastic band 202.

The cord-guide means 100 is mounted on the sewing head 14 beneath one of the guide members 82 and is shown in FIGS. 1 and 3. The cord guide means 100 comprises an elongated guide tube 102 having a funnel-shaped end 104 through which the draw cord 204 enters the guide tube 102. The guide tube 102 functions to properly align the draw cord 204 with the elastic band 202. Preferably, the guide tube 104 should be disposed as close as possible to the pressure foot 20 of the sewing head 14 to accurately position the draw cord 204.

Figure 2:
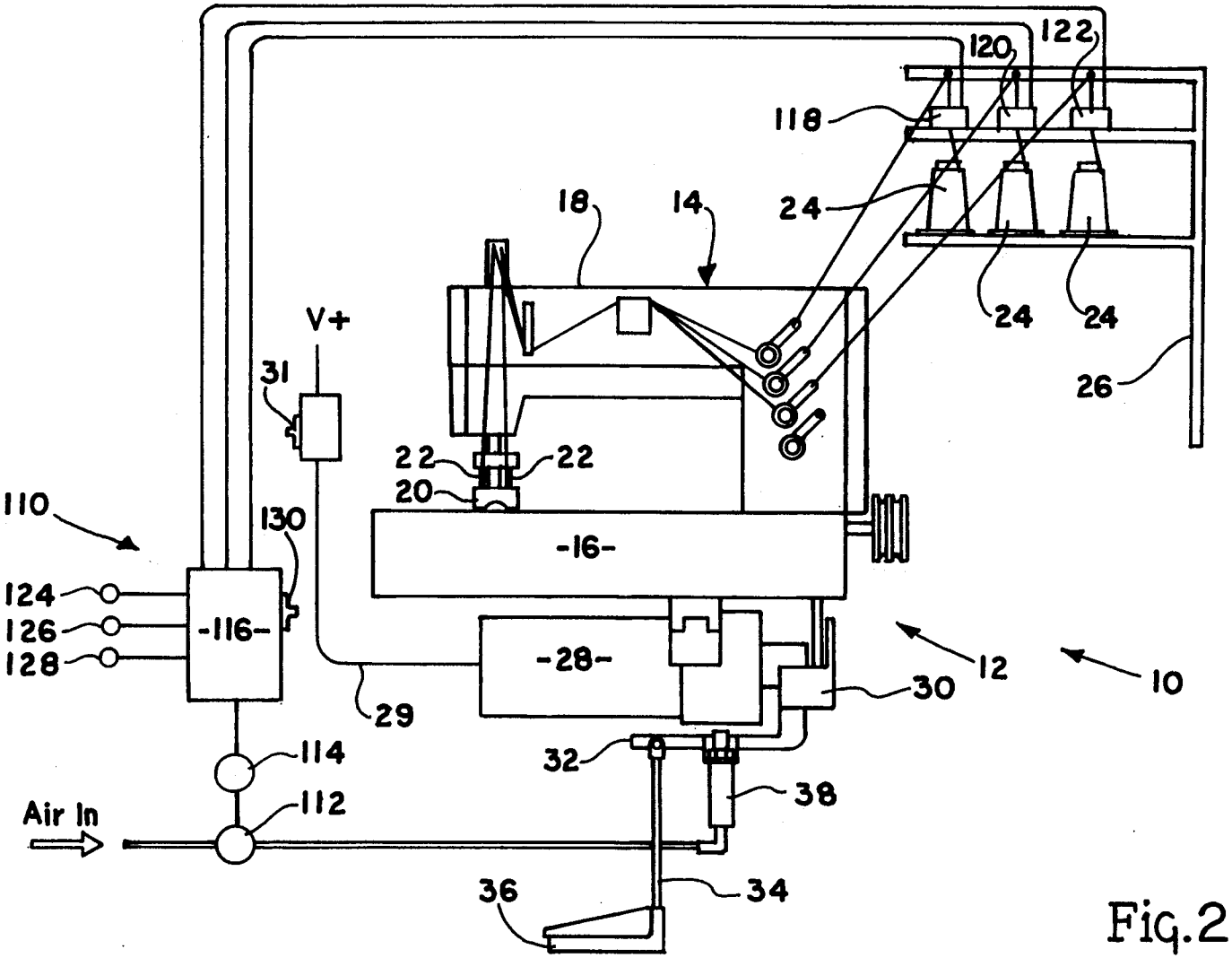
FIG. 2 is a schematic diagram of the sewing apparatus.

Referring now to FIG. 2, the control system 110 for the sewing apparatus 10 is shown. The control system 110 includes an air supply valve 112 for supplying air to the clutch cylinder 38, an electric solenoid 114 for actuating the air supply valve 112, and a controller 116 for operating the solenoid 114. The controller 116 includes a power switch 130 for enabling the controller 116 and placing the sewing apparatus 10 in an automatic mode.

Three thread sensors 118, 120 and 122 are operatively connected to the controller 116. The thread sensors 118, 120, and 122 detect when respective sewing threads break, run out, or slow down below a prescribed speed. The sensors can be adjusted to vary the aforesaid minimum speed. The controller 116 is operative to deactivate the solenoid 114 when any of the sewing threads runs out.

Three micro-switches 124, 126 and 128 are also connected to the controller 116. The first micro-switch 124 detects when the elastic band 202 is out. The second micro-switch 126 detects when the draw cord 204 is out. The third micro-switch 128 detects the presence of knots or kinks in the draw cord 204. The controller 116 stops the sewing operation whenever the elastic band 202 or draw cord 204 runs out, or when a knot is detected in the draw cord 204. The operator can then take the appropriate action to correct the condition and restart operation.

The sewing apparatus of the present invention can be used in either manual mode or automatic mode. To use the sewing apparatus 10 in the manual mode, the main power switch 31 is turned on while the controller switch 130 is turned off. When the main power switch 31 is turned on, the clutch motor 28 is actuated. The sewing machine 12 is operated by depressing the treadle 36 to engage the clutch 30. When the sewing machine 12 is actuated, the feed rollers 42 and draw rollers 62 will be operative to feed and stretch the elastic band 202. The sewing machine 12 will form a hidden stitch in which the looper thread extends around the draw cord 204 to secure the draw cord 204 to the elastic band 202. The looper thread thus forms a longitudinally extending channel in which the draw cord 204 freely slides.

To operate the sewing apparatus in automatic mode, both the main power switch 31 and controller switch 130 must be on. When both switches are turned on, air is supplied via valve 112to cylinder 38. The cylinder 38 pushes the clutch arm 32 down to engage the clutch 30. The sewing machine 12 will then operate continuously until a stop condition is sensed. There are four conditions which will stop operation of the sewing apparatus 10. These conditions are: (1) running out of sewing thread; (2) running out of band material; (3) running out of draw cord; and (4) detection of a knot in the draw cord 204. If any one of these stop conditions is sensed, the controller 116 will shut off the air supply to the clutch cylinder 38 ceasing operation of the sewing machine 12. The operator can then correct the condition which caused the operation to stop.

The sewing apparatus 10 of the present invention provides an easy and convenient method for attaching a draw cord 204 to an elastic band 202 to form a composite band 200. The apparatus of the present invention does not require the use of specialized manufacturing equipment. Further, the apparatus of the present invention avoids the need to specially set up a knitting machine to incorporate the draw cord 204 during the knitting operation. The sewing apparatus of the present invention can be used in line with a knitting machine, or can be used standing alone. Thus, the apparatus of the present invention permits a greater degree of flexibility in operating a manufacturing facility.

The present invention may, of course, be carried out in other specific ways than those herein set forth without departing from the spirit and essential characteristics of the invention. The present embodiments are, therefore, to be considered in all respects as illustrative and not restrictive and all changes coming within the meaning and equivalency range of the appended claims are intended to be embraced therein.

What is claimed is:

1. A method for making a composite band comprising:

(a) feeding an elastic band through a sewing machine;

(b) stretching a segment of the elastic band and maintaining said segment in a stretched condition as it is fed through the sewing machine;

(c) feeding a draw cord through said sewing machine;

(d) guiding the draw cord as it is fed through the sewing machine such that the draw cord is disposed adjacent the stretched segment of the elastic band as the elastic band and draw cord are fed through the machine; and (e) connecting the draw cord to the stretched segment of the elastic band with said sewing machine by forming a plurality of longitudinally-spaced stitches extending over the draw cord, wherein the stitches collectively define a longitudinally-extending channel encasing the draw cord.

2. The method for making a composite band of claim 1 wherein the step of feeding the elastic band comprises passing the elastic band between first and second sets of rollers, one of which is disposed upstream of the sewing machine and the other of which is disposed downstream of the sewing machine.

3. The method of making a composite band of claim 2 wherein the step of stretching the elastic band includes operating the set of rollers downstream of the sewing machine at a higher feed rate than the set of rollers upstream of the sewing machine.

4. An apparatus for making composite bands including an elastic band and a non-elastic draw cord, comprising:

(a) a sewing machine for sewing the draw cord to one surface of the elastic band, said sewing machine including a sewing head arranged and configured to form a plurality of longitudinally-spaced stitches extending over the draw cord and defining a longitudinally-extending channel encasing the draw cord;

(b) band feeding means for feeding the elastic band through the sewing machine;

(c) band guide means for guiding the elastic band as it is fed through the sewing machine;

(d) band stretching means for stretching a segment of the elastic band and maintaining said segment in a stretched condition as it is fed through the sewing machine;

(e) cord feeding means for feeding the draw cord through the sewing machine in side-by-side relationship with the stretched segment of the elastic band; and (f) cord guide means for aligning the draw cord with the elastic band as the draw cord is fed in side-by-side relationship with the elastic band through the sewing machine.

5. The apparatus for making a composite band of claim 4 wherein the band feeding means includes a set of feed rollers disposed upstream from the sewing machine and a set of draw rollers disposed downstream from the sewing machine, wherein said elastic band alone passes between said feed rollers and both the elastic band and the draw cord pass through said draw rollers.

6. The apparatus for making a composite band of claim 5 wherein the draw rollers are operated by drive means at a higher feed rate than the feed rollers to stretch the elastic band as it is fed through the sewing machine.

7. The apparatus for making composite bands of claim 4 wherein the cord feeding means comprises a set of rollers disposed downstream from the sewing machine for advancing the draw cord through the sewing machine.

8. The apparatus for making a composite band of claim 4 wherein the band guide means includes a pair guide members for engaging opposing edges of the elastic band as it is fed through the sewing machine.

9. The apparatus for making composite bands of claim 8 wherein at least one of the guide members includes a slot formed therein so that it is laterally adjustable.

10. The apparatus for making composite bands of claim 4 wherein the cord guide means comprises a guide tube through which the cord passes before reaching the sewing machine.

11. The apparatus for making composite bands of claim 10 wherein the guide tube includes a generally funnel-shaped entrance end.

12. An apparatus for making a composite band including an elastic band and a non-elastic draw cord, comprising:

(a) band feeding means for advancing an elastic band along a path of travel, said band feeding means including means for stretching a segment of the elastic band as it passes through the sewing machine;

(b) cord feeding means for advancing the draw cord in side-by-side relationship with the elastic band; and (c) a sewing machine positioned along the path of travel of the elastic band for sewing the draw cord to the stretched segment of the elastic band wherein the sewing machine includes a sewing head arranged and configured to form a plurality of longitudinally-spaced stitches that extend over the draw cord to form a longitudinally-extending channel encasing the draw cord.

13. The sewing apparatus of claim 12 wherein the band feeding means comprises a set of feed rollers disposed upstream from the sewing machine, a set of draw rollers disposed downstream from the feed rollers on the opposite side of the sewing machine, and drive means for driving the feed rollers and draw rollers.

14. The sewing apparatus of claim 13 wherein the drive means includes means for adjusting the relative feed rate between the feed rollers and the draw rollers to vary the degree of stretching of the elastic band.

15. The sewing apparatus of claim 12 wherein the cord feeding means comprises a set of rollers disposed downstream from the sewing machine for pulling the draw cord through the sewing machine.

16. The sewing apparatus of claim 12 further including guide means for guiding the elastic band as it is advanced along its path of travel, 17. The sewing apparatus of claim 16 wherein the guide means includes a pair of guide members for engaging opposing edges of the elastic band as it advances along its path of travel.

18. The sewing apparatus of claim 17 wherein at least one of the guide members includes a slot formed therein so that it is laterally adjustable.

19. The sewing apparatus of claim 12 further including cord guide means for aligning the draw cord with the elastic band as the elastic band and draw cord advance through the sewing machine.

20. The sewing apparatus of claim 19 wherein the cord guide means comprises a guide tube through which the draw cord passes.

21. The sewing apparatus of claim 20 wherein the guide tube includes a generally funnel-shaped entrance end.

22. A machine for making a composite band from an elastic band and a draw cord comprising:

(a) a sewing machine for securing the draw cord to one surface of the elastic band to form a composite band, wherein the sewing machine includes a sewing head arranged and configured to form a plurality of longitudinally spaced stitches extending over the draw cord which defines a longitudinally-extending channel for the draw cord;

(b) a first set of rollers disposed upstream from the sewing machine and in rolling contact with the elastic band for advancing the elastic band towards the sewing machine;

(c) a second set of rollers disposed downstream from the sewing machine in rolling contact with the composite band, said second set of rollers being operative to feed the draw cord through the sewing machine;

(d) a draw cord guide for guiding the draw cord into side-by-side relationship with the elastic band as the draw cord and elastic band are fed through the sewing machine such that the sewing machine may secure the draw cord to one surface of the elastic band to form the band; and (e) drive means for driving both the first and second sets of rollers, said drive means being operative to drive the second set of rollers at a greater speed than the first set of rollers to stretch a segment of the elastic band between said first and second sets of rollers and for maintaining said segment in a stretched condition during the sewing operation.

23. An apparatus for making composite bands including an elastic band and a non-elastic draw cord and for use in conjunction with a sewing machine for sewing the draw cord to one surface of the elastic band, the sewing machine including a sewing head arranged and configured to form a plurality of longitudinally-spaced stitches extending over the draw cord and defining a longitudinally-extending channel encasing the draw cord, said apparatus comprising:

(a) band feeding means for feeding the elastic band through the sewing machine;

(b) band guide means for guiding the elastic band as it is fed through the sewing machine;

(c) band stretching means for stretching a segment of the elastic band and maintaining said segment in a stretched condition as it is fed through the sewing machine;

(d) cord feeding means for feeding the draw cord through the sewing machine in side-by-side relationship with the stretched segment of the elastic band; and (e) cord guide means for aligning the draw cord with the elastic band as the draw cord is fed in side-by-side relationship with the elastic band through the sewing machine.

24. The apparatus for making composite bands of claim 23 wherein the band feeding means includes a set of feed rollers disposed upstream from the sewing machine and a set of draw rollers disposed downstream from the sewing machine, wherein said elastic band alone passes between said feed rollers and both the elastic band and the draw cord pass through said draw rollers.

25. The apparatus for making composite bands of claim 24 wherein the draw rollers are operated by drive means at a higher feed rate than the feed rollers to stretch the elastic band as it is fed through the sewing machine.

26. The apparatus for making composite bands of claim 23 wherein the cord feeding means comprises a set of rollers disposed downstream from the sewing machine for advancing the draw cord through the sewing machine.

27. The apparatus for making composite bands of claim 23 wherein the band guide means includes a pair of guide members for engaging opposing edges of the elastic band as it is fed through the sewing machine.

28. The apparatus for making composite bands of claim 27 wherein at least one of the guide members includes a slot formed therein so that it is laterally adjustable.

29. The apparatus for making composite bands of claim 23 wherein the cord guide means comprises a guide tube through which the cord passes before reaching the sewing machine.

30. The apparatus for making composite bands of claim 29 wherein the guide tube includes a generally funnel-shaped entrance end.

31. An apparatus for making a composite band including an elastic band and a non-elastic draw cord and for use in conjunction with a sewing machine, wherein the sewing machine includes a sewing head arranged and configured to form a plurality of longitudinally-spaced stitches that extend over the draw cord to form a longitudinally-extending channel encasing the draw cord, said apparatus comprising:

(a) band-feeding means for advancing the elastic band along a path of travel, said band feeding means including means for stretching a segment of the elastic band as it passes through the sewing machine;

(b) cord feeding means for advancing the draw cord in side-by-side relationship with the elastic band; and (c) wherein the sewing machine may be positioned along the path of travel of the elastic band for sewing the draw cord to the stretched segment of the elastic band.

32. The apparatus of claim 31 wherein the band feeding means comprises a set of feed rollers disposed upstream from the sewing machine, a set of draw rollers disposed downstream from the feed rollers on the opposite side of the sewing machine, and drive means for driving the feed rollers and draw rollers.

33. The apparatus of claim 32 wherein the drive means includes means for adjusting the relative feed rate between the feed rollers and the draw rollers to vary the degree of stretching of the elastic band.

34. The apparatus of claim 31 wherein the cord feeding means comprises a set of rollers disposed downstream from the sewing machine for pulling the draw cord through the sewing machine.

35. The apparatus of claim 31 further including guide means for guiding the elastic band as it is advanced along its path of travel.

36. The apparatus of claim 35 wherein the guide means includes a pair of guide members for engaging opposing edges of the elastic band as it advances along its path of travel.

37. The apparatus of claim 36 wherein the guide members are laterally adjustable.

38. The apparatus of claim 31 further including cord guide means for aligning the draw cord with the elastic band as the elastic band and draw cord advance through the sewing machine.

39. The apparatus of claim 38 wherein the cord guide means comprises a guide tube through which the draw cord passes.

40. The apparatus of claim 29 wherein the guide tube includes a generally funnel-shaped entrance end.

41. A machine for making a composite band from an elastic band and a draw cord and for use with a sewing machine for securing the draw cord to one surface of the elastic band to form the composite band, wherein the sewing machine includes a sewing head arranged and configured to form a plurality of longitudinally spaced stitches extending over the draw cord which defines a longitudinally-extending channel for the draw cord, said machine comprising:

(a) a first set of rollers disposed upstream from the sewing machine and in rolling contact with the elastic band for advancing the elastic band towards the sewing machine;

(b) a second set of rollers disposed downstream from the sewing machine in rolling contact with the composite band, said second set of rollers being operative to feed the draw cord through the sewing machine;

(c) a draw cord guide for guiding the draw cord into side-by-side relationship with the elastic band as the draw cord and elastic band are fed through the sewing machine such that the sewing machine may secure the draw cord to one surface of the elastic band to form the composite band; and (d) drive means for driving both the first and second sets of rollers, said drive means being operative to drive the second set of rollers at a greater speed than the first set of rollers to stretch a segment of the elastic band between said first and second sets of rollers and for maintaining said segment in a stretched condition during the sewing operation.

* * * * *